US008471149B2

(12) United States Patent
Huynh

(10) Patent No.: US 8,471,149 B2
(45) Date of Patent: Jun. 25, 2013

(54) SHIELDED ELECTRICAL CABLE AND METHOD OF MAKING THE SAME

(75) Inventor: Ky Huynh, Tigard, OR (US)

(73) Assignee: Technical Services for Electronics, Inc., Arlington, MN (US)

( * ) Notice: Subject to any disclaimer, the term of this patent is extended or adjusted under 35 U.S.C. 154(b) by 570 days.

(21) Appl. No.: 12/717,682

(22) Filed: Mar. 4, 2010

(65) Prior Publication Data

US 2011/0214898 A1 Sep. 8, 2011

(51) Int. Cl.
*H01B 7/18* (2006.01)
*H01B 9/02* (2006.01)

(52) U.S. Cl.
USPC ..... 174/105 R; 174/102 R; 174/107; 174/108; 174/113 R

(58) Field of Classification Search
USPC ..... 174/105 R, 102 R, 107, 108, 113 R, 174/105 B
See application file for complete search history.

(56) References Cited

U.S. PATENT DOCUMENTS

| | | | | |
|---|---|---|---|---|
| 2,012,126 | A | 8/1935 | Gilbert | |
| 2,604,509 | A * | 7/1952 | Blanchard | 174/108 |
| 5,834,698 | A | 11/1998 | Izui | |
| 6,720,497 | B1 | 4/2004 | Barsne | |
| 6,766,578 | B1 | 7/2004 | Swanson | |
| 6,967,288 | B2 | 11/2005 | Ohsawa et al. | |
| 7,793,409 | B2 * | 9/2010 | Varkey | 29/825 |
| 2002/0003046 | A1 | 1/2002 | Clouet et al. | |
| 2004/0055776 | A1 | 3/2004 | Milijasevic | |
| 2005/0006130 | A1 | 1/2005 | Kimijima et al. | |
| 2005/0072594 | A1 | 4/2005 | Gray | |
| 2005/0247472 | A1 | 11/2005 | Helfer | |
| 2006/0204752 | A1 | 9/2006 | Frank | |
| 2009/0166054 | A1 | 7/2009 | Archambeault et al. | |
| 2009/0283296 | A1 * | 11/2009 | Shimosawa et al. | 174/107 |

* cited by examiner

*Primary Examiner* — Jayprakash N Gandhi
*Assistant Examiner* — Dion Ferguson
(74) *Attorney, Agent, or Firm* — Timothy E. Seigel Patent Law, PLLC; Timothy E. Siegel

(57) ABSTRACT

A shielded electrical cable that has a set of insulated inner conductors and a shield made of a plurality of insulated wires, arranged about said inner conductors. Each insulated wire of the shield has a conductive core coated by insulation which is fused together with the insulation of the neighboring wires. Also, said conductive cores of said plurality of insulated wires are brought into mutual electrical contact at a longitudinal interval of said twisted shielded pair.

4 Claims, 3 Drawing Sheets

SHIELDED ELECTRICAL CABLE AND METHOD OF MAKING THE SAME

BACKGROUND

Shielded electrical cables, including twisted shielded pairs (TSPs) of wires, are a common feature of many electrical designs, due to their inexpensive construction and good resistance to electromagnetic interference. But it has been a challenge to make twisted shielded pairs with the small diameters that are preferable in the construction of biomedical devices, as well as other applications.

It is typical to form a TSP creating a twisted pair of insulated wires, serving bare conductive wires about this twisted pair and then running the resultant work piece through a bath of melted polymer, thereby placing a protective coating of polymeric insulation about the shield. Using this technique it has been difficult to form a twisted shielded pair having a uniform diameter over its length, and having a diameter of less than 0.2 mm. For those using twisted shielded pairs for biomedical applications, it is desirable to be able to produce this product with diameters smaller than 0.2 mm. Having a uniform diameter over the length of the TSP is also desirable.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a shielded electrical cable that has a set of insulated inner conductors and a shield made of a plurality of insulated wires, arranged about the inner conductors. Each insulated wire of the shield has a conductive core coated by insulation which is fused together with the insulation of the neighboring wires. Also, the conductive cores of the plurality of insulated wires are brought into mutual electrical contact at a longitudinal interval of the twisted shielded pair.

In a second separate aspect, the present invention may take the form of a twisted shielded pair of wires that has an inner pair of insulated wires twisted together, the wires having a conductive core made of a material having electrical resistivity of less than $10^{-7}$ ohm*m and insulation having an electrical resistivity of greater than $10^{4}$ ohm*m. Also, an outer layer of wires is arranged about the inner pair of insulated wires, and is held in place by insulation. Finally, the twisted shielded pair of wires has a diameter of less than 80 microns.

In a third separate aspect, the present invention is a method of making a shielded electrical cable that uses an insulated set of wires. First, a multiplicity of insulated wires are arranged about the insulated set of wires, thereby forming a work piece. Some insulation of the multiplicity of insulated wires has a first melting point and insulation of the insulated set of wires has a second melting point. The first melting point is lower than the second melting point. Finally, the work piece through an oven set at a temperature between the first melting point and second melting point for long enough for the insulation having a first melting point to soften and fuse together.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Figure 1A:
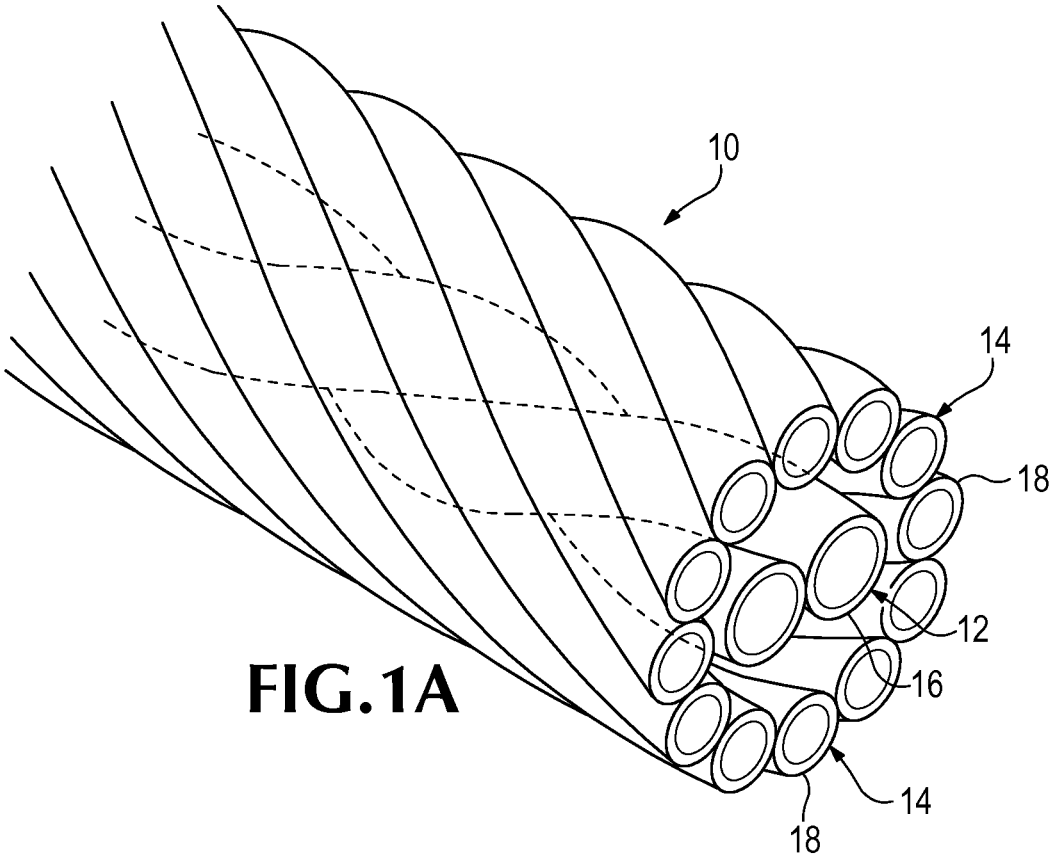
FIG. 1A is a perspective view of a work piece that represents an intermediate step in the process of the present invention.
Figure 1B:
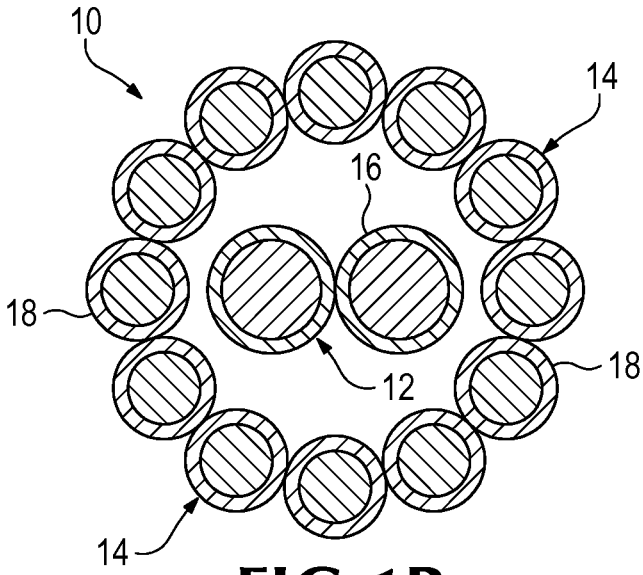
FIG. 1B is a cross-sectional view of the work piece of FIG. 1A.

In one preferred embodiment the present invention takes the form of a method of producing a twisted-shielded pair, which is a particular type of a shielded electrical cable. Referring to FIGS. 1A and 1B, this begins with a work piece 10, made of a pair of insulated wires 12, twisted together with a plurality of insulated wires 14 arranged about twisted pair 12. The insulation 16 of wires 10 is made of a high temperature polymer such as polytetrafluoroethylene, polyimide or a high temperature polyamide and has a melting point in excess of 275° C. The insulation 18 of wires 12, on the other hand, is made of a lower temperature polymer, such as a nylon (which is a low temperature polyamide), a polyvinyl or a polyurethane. In one preferred embodiment the low temperature polymer forms an outer coating, over an inner polymer coating of a high temperature polymer, such as a high temperature polyamide.

Figure 2A:
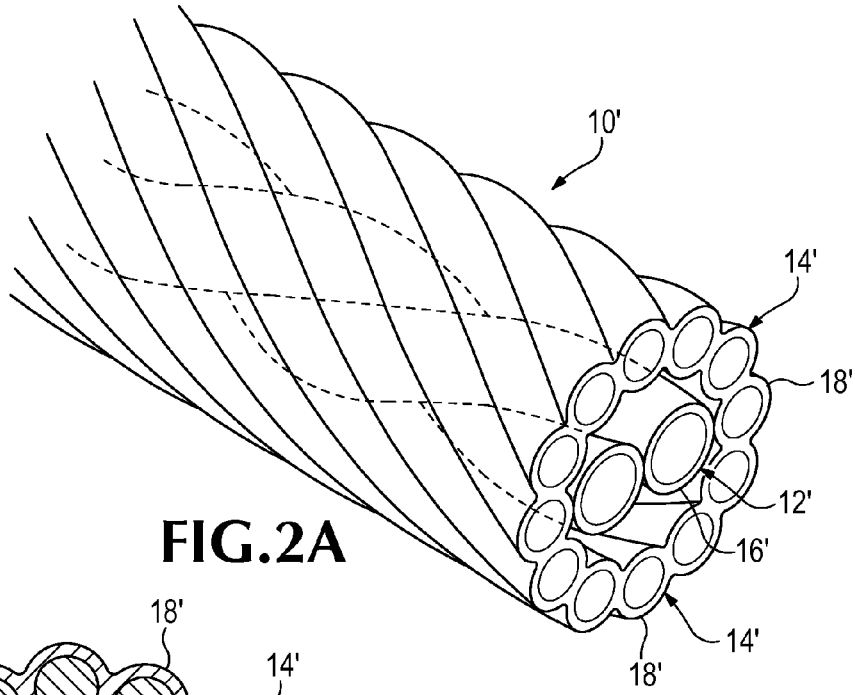
FIG. 2A is a perspective view of a twisted shielded pair of wires made from the work piece of FIG. 1A.
Figure 2B:
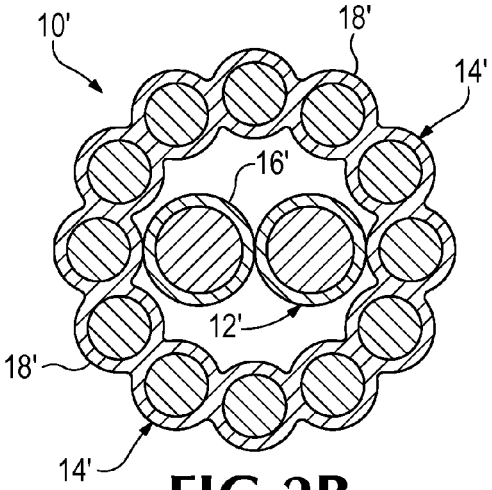
FIG. 2B is a cross-sectional view of the twisted shielded pair of FIG. 2A.

Work piece 10 is fed through an oven having a temperature of less than 275° C., but greater than the melting point of the low temperature polymer used in insulation 18 (typically about 200° C.). Work piece 10 is permitted to dwell in this oven long enough for the low temperature polymer to soften and for coating of individual wires 14 to meld together into a unitary shield. Referring to FIGS. 2A and 2B, in the finished shielded cable 10' insulation 18', part of insulated shield wires 14', is melded together, forming a structurally sound, flexible shield.

Figure 3:
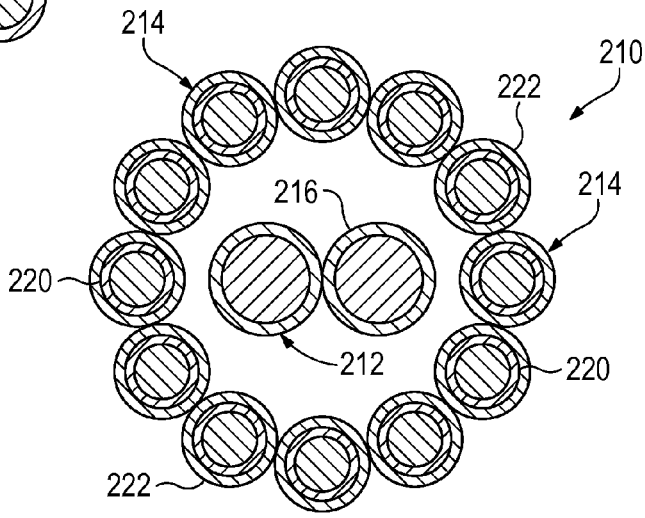
FIG. 3 is a cross-sectional view of a work piece that represents an intermediate step in the process of an alternative preferred embodiment of the present invention.
Figure 4:
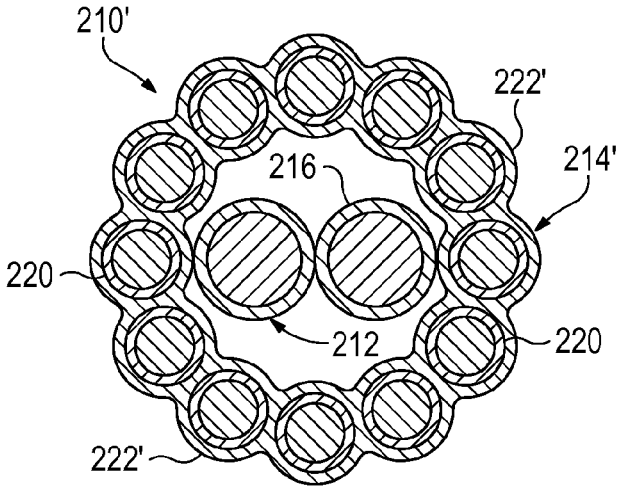
FIG. 4 is a cross-sectional view of a twisted shielded pair of wires made from the work piece of FIG. 3.

In an alternative preferred embodiment, shown in FIGS. 3 and 4, a set of shield wires 214 of a work piece 210 have shield wire insulation that includes an inner layer 220, having a melting temperature of greater than about 275° C. and an outer layer 222 having a lower temperature melting point, typically of about 200° C. This arrangement helps to create a set of shield wires with a very uniform spacing.

Figure 5:
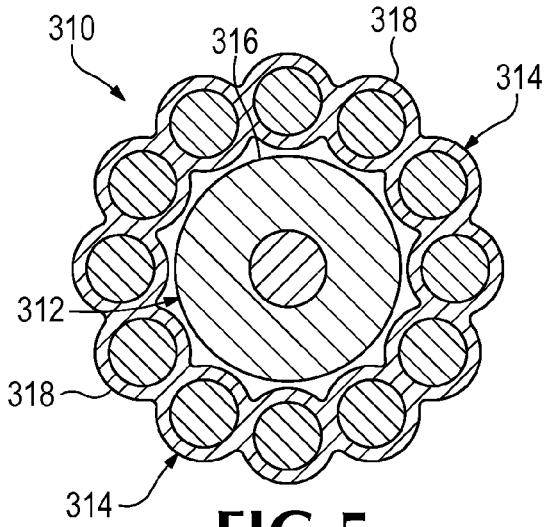
FIG. 5 is a cross-sectional view of a coaxial cable made according to an alternative preferred embodiment of the present invention.

Referring to FIG. 5, in an additional alternative embodiment the same basic technology is used to make a shielded single wire, more commonly referred to as a coaxial cable 310. Insulated wires 314 are wrapped or braided about a single insulated wire 312. The resultant work piece is then passed through an oven to soften and fuse the low-melting-point insulation 318 of outer wires 314, while leaving intact the higher-melting-point insulation 316 of central wire 312.

Figure 6:
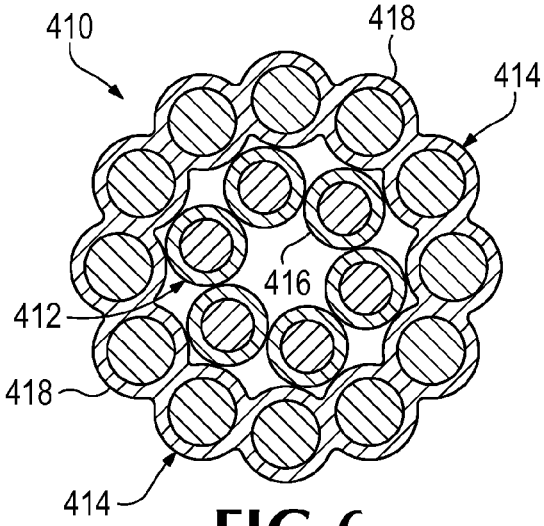
FIG. 6 is a cross-sectional view of multi-conductor cable made according to an additional alternative preferred embodiment of the present invention.

Referring to FIG. 6, in yet another preferred embodiment a shielded multi-conductor cable 410 is produced. Insulated wires 414 are wrapped or braided about a plurality of insulated wires 412. The resultant work piece is then passed through an oven to soften and fuse the low-melting-point insulation 418 of outer wires 414, while leaving intact the higher-melting-point insulation 416 of central wires 412.

Using this technique, a twisted shielded pair of wires can been made with a diameter of 92 microns (3.6 mils), or smaller, having excellent structural properties. The even spacing of the shield wires, due to the insulation layer, results in a good shield without inadvertent gaps caused by wire separation during processing. The 92 microns diameter embodiment is made of 25.4 microns diameter wire for the twisted pair and 20.6 microns diameter wire for the shield wires. In an additional preferred embodiment smaller diameter wires are used. The twisted pair of wires has a conductive core of 25 microns and the shield wires have a core of 20 microns. Moreover, the even spacing of the wires and the melding together of the polymeric insulation creates a cable which has good tensile strength and uniformity of cross-sectional characteristics such as diameter. Moreover the resultant product has excellent longitudinal flexibility. The technique can be generalized to permit the production of coaxial cables having very thin diameters and excellent structural characteristics. Even multi-conductor shielded cables can be made according to this technique.

In one application a number of twisted shielded pairs made according to the above described technique are bound together to form part of a medical cable, for example a catheter cable. The small diameter and good flexibility of each twisted shielded pair results in a medical cable that is, in turn, thin, flexible and durable. Catheter cables are sometimes twisted and pulled during use, so good mechanical properties are very important.

In the nomenclature of this application the term "set" may refer to a set having only a single member.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A twisted shielded pair of wires, comprising:

(a) an inner pair of insulated wires twisted together, said wires having a conductive core made of a material having electrical resistivity of less than $10^{-7}$ ohm*m and insulation having an electrical resistivity of greater than $10^{4}$ ohm*m;

(b) an outer layer of wires arranged about said inner pair of insulated wires, and wherein said outer layer of wires is held in place by insulation; and (c) wherein said twisted shielded pair of wires has a diameter of less than 100 microns.

2. The twisted shielded pair of wires of claim 1, having a diameter of less than 80 microns.

3. The twisted shielded pair of wires of claim 1, having a diameter of less than 50 microns.

4. The twisted shielded pair of wires of claim 1, wherein said plurality of wires are uniformly spaced apart with a variation from the mean spacing of greater than 50% occurring less than 5% over the length of the twisted shielded pair.

* * * * *